US006531941B1

(12) United States Patent
Greenberg et al.

(10) Patent No.: US 6,531,941 B1
(45) Date of Patent: Mar. 11, 2003

(54) CLIP FOR A CONDUCTOR IN A ROTARY BREAKER

(75) Inventors: Randall Lee Greenberg, Granby, CT (US); Roger Neil Castonguay, Terryville, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/692,783

(22) Filed: Oct. 19, 2000

(51) Int. Cl.[7] ..... H01H 9/02
(52) U.S. Cl. ..... 335/202; 200/293; 439/810
(58) Field of Search ..... 335/16, 202; 200/293–312; 439/510–814; 361/627–640

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 4,059,335 A | * | 11/1977 | Simon | 439/810 |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Hennemann | |
| 4,166,988 A | | 9/1979 | Ciarcia et al. | |
| 4,220,934 A | | 9/1980 | Wafer et al. | |
| 4,255,732 A | | 3/1981 | Wafer et al. | |
| 4,259,651 A | | 3/1981 | Yamat | |
| 4,263,492 A | | 4/1981 | Maier et al. | |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |

(List continued on next page.)

*Primary Examiner*—Lincoln Donovan
(74) *Attorney, Agent, or Firm*—Cantor Colburn LLP

(57) ABSTRACT

A clip designed to retain a conductive strap to a circuit breaker case is disclosed. The clip comprises a main body portion and a flange. The main body portion includes a first edge and a second edge. The flange depends from the first edge of the main body portion and includes a first end and a second end. The first end of the flange is configured for attachment to the conductor strap and the second end of the flange and the main body portion configured to secure the conductor strap in mounting stability within the case and to prevent movement of the conductor strap relative to the case.

10 Claims, 8 Drawing Sheets

U.S. PATENT DOCUMENTS

| | | | |
|---|---|---|---|
| 4,276,527 | A | 6/1981 | Gerbert-Gaillard et al. |
| 4,297,663 | A | 10/1981 | Seymour et al. |
| 4,301,342 | A | 11/1981 | Castonguay et al. |
| 4,360,852 | A | 11/1982 | Gilmore |
| 4,368,444 | A | 1/1983 | Preuss et al. |
| 4,375,021 | A | 2/1983 | Pardini et al. |
| 4,375,022 | A | 2/1983 | Daussin et al. |
| 4,376,270 | A | 3/1983 | Staffen |
| 4,383,146 | A | 5/1983 | Bur |
| 4,392,036 | A | 7/1983 | Troebel et al. |
| 4,393,283 | A | 7/1983 | Masuda |
| 4,401,872 | A | 8/1983 | Boichot-Castagne et al. |
| 4,409,573 | A | 10/1983 | DiMarco et al. |
| 4,435,690 | A | 3/1984 | Link et al. |
| 4,467,297 | A | 8/1984 | Boichot-Castagne et al. |
| 4,468,645 | A | 8/1984 | Gerbert-Gaillard et al. |
| 4,470,027 | A | 9/1984 | Link et al. |
| 4,479,143 | A | 10/1984 | Watanabe et al. |
| 4,488,133 | A | 12/1984 | McClellan et al. |
| 4,492,941 | A | 1/1985 | Nagle |
| 4,541,032 | A | 9/1985 | Schwab |
| 4,546,224 | A | 10/1985 | Mostosi |
| 4,550,360 | A | 10/1985 | Dougherty |
| 4,562,419 | A | 12/1985 | Preuss et al. |
| 4,589,052 | A | 5/1986 | Dougherty |
| 4,595,812 | A | 6/1986 | Tamaru et al. |
| 4,611,187 | A | 9/1986 | Banfi |
| 4,612,430 | A | 9/1986 | Sloan et al. |
| 4,616,198 | A | 10/1986 | Pardini |
| 4,622,444 | A | 11/1986 | Kandatsu et al. |
| 4,631,625 | A | 12/1986 | Alexander et al. |
| 4,642,431 | A | 2/1987 | Tedesco et al. |
| 4,644,438 | A | 2/1987 | Puccinelli et al. |
| 4,649,247 | A | 3/1987 | Preuss et al. |
| 4,658,322 | A | 4/1987 | Rivera |
| 4,672,501 | A | 6/1987 | Bilac et al. |
| 4,675,481 | A | 6/1987 | Markowski et al. |
| 4,682,264 | A | 7/1987 | Demeyer |
| 4,689,712 | A | 8/1987 | Demeyer |
| 4,694,373 | A | 9/1987 | Demeyer |
| 4,710,845 | A | 12/1987 | Demeyer |
| 4,717,985 | A | 1/1988 | Demeyer |
| 4,733,211 | A | 3/1988 | Castonguay et al. |
| 4,733,321 | A | 3/1988 | Lindperg |
| 4,764,650 | A | 8/1988 | Bur et al. |
| 4,768,007 | A | 8/1988 | Mertz et al. |
| 4,780,786 | A | 10/1988 | Weynachter et al. |
| 4,831,221 | A | 5/1989 | Yu et al. |
| 4,870,531 | A | 9/1989 | Danek |
| 4,883,931 | A | 11/1989 | Batteux et al. |
| 4,884,047 | A | 11/1989 | Baginski et al. |
| 4,884,164 | A | 11/1989 | Dziura et al. |
| 4,900,882 | A | 2/1990 | Bernard et al. |
| 4,910,485 | A | 3/1990 | Bolongeat-Mobleu st al. |
| 4,914,541 | A | 4/1990 | Tripodi et al. |
| 4,916,420 | A | 4/1990 | Bartolo et al. |
| 4,916,421 | A | 4/1990 | Pardini et al. |
| 4,926,282 | A | 5/1990 | McGhie |
| 4,935,590 | A | 6/1990 | Malkin et al. |
| 4,937,706 | A | 6/1990 | Schueller et al. |
| 4,939,492 | A | 7/1990 | Raso et al. |
| 4,943,691 | A | 7/1990 | Mertz et al. |
| 4,943,888 | A | 7/1990 | Jacob et al. |
| 4,950,855 | A | 8/1990 | Bolonegeat-Mobleu et al. |
| 4,951,019 | A | 8/1990 | Gula |
| 4,952,897 | A | 8/1990 | Barnel |
| 4,958,135 | A | 9/1990 | Baginski et al. |
| 4,965,543 | A | 10/1990 | Batteux |
| 4,983,788 | A | 1/1991 | Pardini |
| 5,001,313 | A | 3/1991 | Leclerq et al. |
| 5,004,878 | A | 4/1991 | Seymour et al. |
| 5,029,301 | A | 7/1991 | Nebon et al. |
| 5,030,804 | A | 7/1991 | Abri |
| 5,057,655 | A | 10/1991 | Kersusan et al. |
| 5,077,627 | A | 12/1991 | Fraisse |
| 5,083,081 | A | 1/1992 | Barrault et al. |
| 5,095,183 | A | 3/1992 | Raphard et al. |
| 5,103,198 | A | 4/1992 | Morel et al. |
| 5,115,371 | A | 5/1992 | Tripodi |
| 5,120,921 | A | 6/1992 | DiMarco et al. |
| 5,132,865 | A | 7/1992 | Mertz et al. |
| 5,138,121 | A | 8/1992 | Streich et al. |
| 5,140,115 | A | 8/1992 | Morris |
| 5,153,802 | A | 10/1992 | Mertz et al. |
| 5,155,315 | A | 10/1992 | Malkin et al. |
| 5,166,483 | A | 11/1992 | Kersusan et al. |
| 5,172,087 | A | 12/1992 | Castonguay et al. |
| 5,178,504 | A | 1/1993 | Falchi |
| 5,184,717 | A | 2/1993 | Chou et al. |
| 5,187,339 | A | 2/1993 | Lissandrin |
| 5,198,956 | A | 3/1993 | Dvorak |
| 5,200,724 | A | 4/1993 | Gula et al. |
| 5,210,385 | A | 5/1993 | Morel et al. |
| 5,239,150 | A | 8/1993 | Bolongeat-Mobleu et al. |
| 5,260,533 | A | 11/1993 | Livesey et al. |
| 5,262,744 | A | 11/1993 | Arnold et al. |
| 5,280,144 | A | 1/1994 | Bolongeat-Mobleu et al. |
| 5,281,776 | A | 1/1994 | Morel et al. |
| 5,296,660 | A | 3/1994 | Morel et al. |
| 5,296,664 | A | 3/1994 | Crookston et al. |
| 5,298,874 | A | 3/1994 | Morel et al. |
| 5,300,907 | A | 4/1994 | Nereau et al. |
| 5,310,971 | A | 5/1994 | Vial et al. |
| 5,313,180 | A | 5/1994 | Vial et al. |
| 5,317,471 | A | 5/1994 | Izoard et al. |
| 5,331,500 | A | 7/1994 | Corcoles et al. |
| 5,334,808 | A | 8/1994 | Bur et al. |
| 5,341,191 | A | 8/1994 | Crookston et al. |
| 5,347,096 | A | 9/1994 | Bolongeat-Mobleu et al. |
| 5,347,097 | A | 9/1994 | Bolongeat-Mobleu et al. |
| 5,350,892 | A | 9/1994 | Rozier |
| 5,357,066 | A | 10/1994 | Morel et al. |
| 5,357,068 | A | 10/1994 | Rozier |
| 5,357,394 | A | 10/1994 | Piney |
| 5,361,052 | A | 11/1994 | Ferullo et al. |
| 5,373,130 | A | 12/1994 | Barrault et al. |
| 5,379,013 | A | 1/1995 | Coudert |
| 5,424,701 | A | 6/1995 | Castonguary et al. |
| 5,438,176 | A | 8/1995 | Bonnardel et al. |
| 5,440,088 | A | 8/1995 | Coudert et al. |
| 5,449,871 | A | 9/1995 | Batteux et al. |
| 5,450,048 | A | 9/1995 | Leger et al. |
| 5,451,729 | A | 9/1995 | Onderka et al. |
| 5,457,295 | A | 10/1995 | Tanibe et al. |
| 5,467,069 | A | 11/1995 | Payet-Burin et al. |
| 5,469,121 | A | 11/1995 | Payet-Burin |
| 5,475,558 | A | 12/1995 | Barjonnet et al. |
| 5,477,016 | A | 12/1995 | Baginski et al. |
| 5,479,143 | A | 12/1995 | Payet-Burin |
| 5,483,212 | A | 1/1996 | Lankuttis et al. |
| 5,485,343 | A | 1/1996 | Santos et al. |
| D367,265 | S | 2/1996 | Yamagata et al. |
| 5,493,083 | A | 2/1996 | Olivier |
| 5,493,085 | A * | 2/1996 | Kolberg et al. ..... 200/284 |
| 5,504,284 | A | 4/1996 | Lazareth et al. |
| 5,504,290 | A | 4/1996 | Baginski et al. |
| 5,510,761 | A | 4/1996 | Boder et al. |
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |

| | | | | | |
|---|---|---|---|---|---|
| 5,534,832 | A | | 7/1996 | Duchemin et al. | |
| 5,534,835 | A | | 7/1996 | McColloch et al. | |
| 5,534,840 | A | | 7/1996 | Cuingnet | |
| 5,539,168 | A | | 7/1996 | Linzenich | |
| 5,543,595 | A | | 8/1996 | Mader et al. | |
| 5,552,755 | A | | 9/1996 | Fello et al. | |
| 5,581,219 | A | | 12/1996 | Nozawa et al. | |
| 5,604,656 | A | | 2/1997 | Derrick et al. | |
| 5,608,367 | A | | 3/1997 | Zoller et al. | |
| 5,784,233 | A | | 7/1998 | Bastard et al. | |
| 6,102,750 | A | * | 8/2000 | Little et al. | 439/813 |
| 6,198,615 | B1 | * | 3/2001 | Pelosi et al. | 361/119 |

FOREIGN PATENT DOCUMENTS

| | | |
|---|---|---|
| EP | 0 064 906 | 11/1982 |
| EP | 0 066 486 | 12/1982 |
| EP | 0 076 719 | 4/1983 |
| EP | 0 117 904 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

CLIP FOR A CONDUCTOR IN A ROTARY BREAKER

BACKGROUND OF THE INVENTION

The present invention relates generally to clips and more particularly to a clip for attaching to a conductor (strap) in a rotary contact circuit breaker.

Circuit breakers are one of a variety of overcurrent protective devices used for circuit protection and isolation. The basic function of a circuit breaker is to provide electrical system protection whenever an electrical abnormality occurs in any part of the system. In a rotary contact circuit breaker, current enters the system from a power source. The current passes through a line strap to a fixed contact mounted on the line strap and then to a moveable contact. The moveable contact is fixedly attached to an arm, and the arm is mounted to a rotor that in turn is rotatably mounted in a cassette. As long as the fixed contact is in physical contact with the moveable contact, the current passes from the fixed contact to the moveable contact and out of the circuit breaker to downstream electrical devices.

In the event of an extremely high overcurrent condition (e.g. a short circuit), electromagnetic forces are generated between the fixed and moveable contacts. These electromagnetic forces repel the movable contact away from the fixed contact. Because the moveable contact is fixedly attached to a rotating arm, the arm pivots and physically separates the fixed contact from the moveable contact.

Once activated, the circuit breaker operating mechanism separates a pair of main contacts to stop the flow of current in the protected circuit. Conventional trip units act directly upon the circuit breaker operating mechanism to activate the circuit breaker operating mechanism.

During an interruption event, such as a short circuit, high levels of energy travel through the load side strap (conductor). During these events, the load side conductor experiences forces causing undesirable rotational and translational movement of the conductor. Typically, load side conductor connections are fixedly supported within the circuit breaker case to absorb the energy passing through during interruption as well as during assembly when electrical connections are made to the load side conductors. However, to fixedly support the load side strap can require additional space in which to provide and mount a supporting structure for the load side conductors and connections.

SUMMARY OF THE INVENTION

The above discussed and other drawbacks and deficiencies are overcome or alleviated by a clip for retaining a conductive strap to a circuit breaker case is disclosed. The clip comprises a main body portion and a flange. The main body portion includes a first edge and a second edge. The flange depends from the first edge of the main body portion and includes a first end and a second end. The first end of the flange is configured for attachment to the conductor strap and the second end of the flange and the main body portion configured to secure the conductor strap in mounting stability within the case and to minimize movement of the conductor strap relative to the case.

BRIEF DESCRIPTION OF THE DRAWINGS

The present invention will now be described, by way of example, with reference to the following FIGURES, in which.

DETAILED DESCRIPTION OF THE INVENTION

Figure 1:
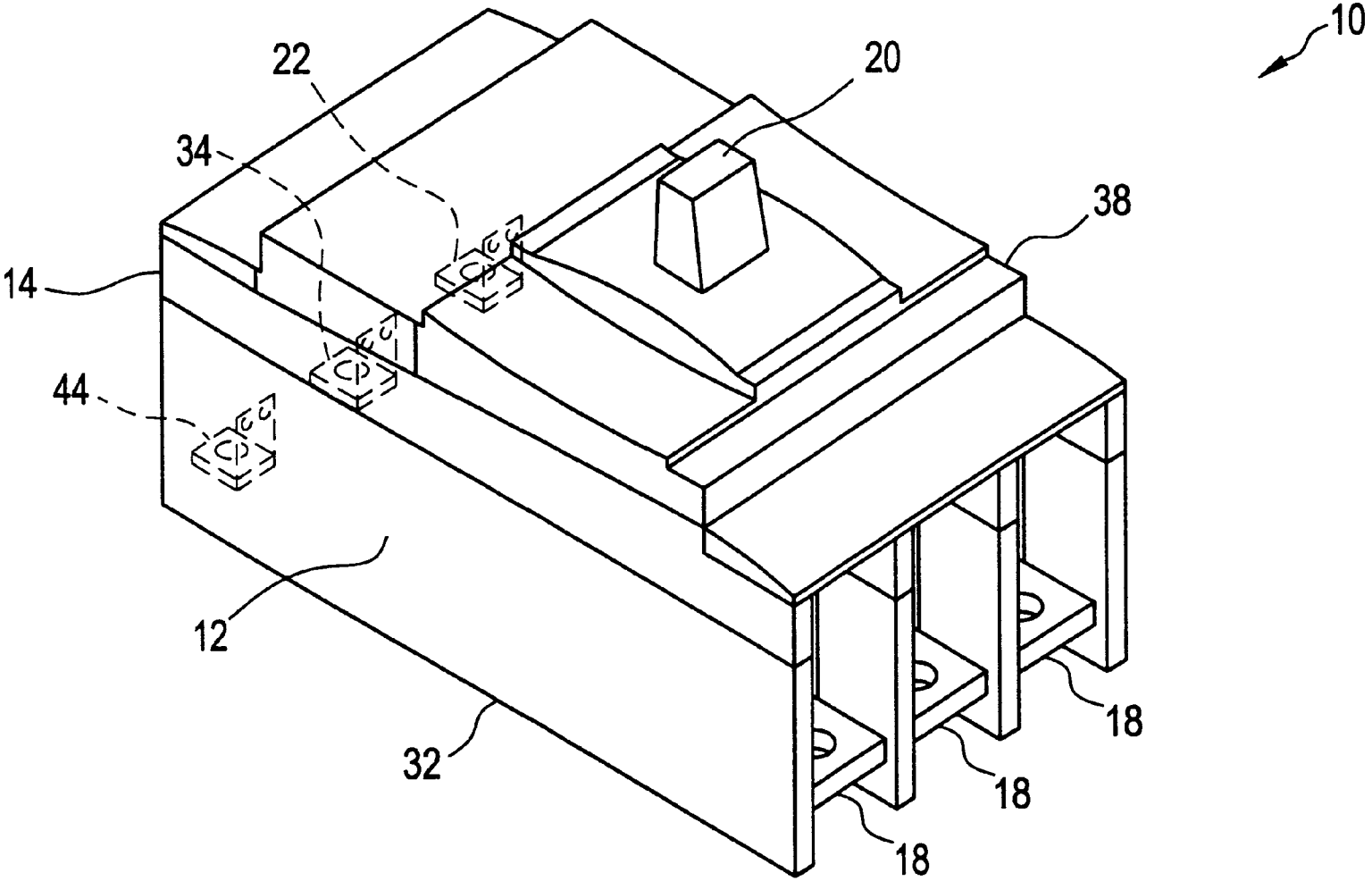
FIG. 1 is a perspective view of a circuit breaker including a base.

Referring to FIG. 1, an embodiment of a molded case circuit breaker 10 is generally shown. Circuit breakers of this type generally an insulated case 12 having a cover 38 attached to a mid-cover 14 coupled to a base 32. A handle 20 extending through cover 38 gives the operator the ability to turn the circuit breaker 10 "on" to energize a protected circuit (not shown), turn the circuit breaker "off" to disconnect the protected circuit (shown in FIG. 3), or "reset" the circuit breaker after a fault (not shown). A plurality of line and load straps (conductors) 18, 22, 34, 44 also extend through the case 12. The circuit breaker 10 in FIG. 1 shows a typical three phase configuration, however, the present invention is not limited to this configuration but may be applied to other configurations, such as one, two or four phase circuit breakers.

Figure 2:
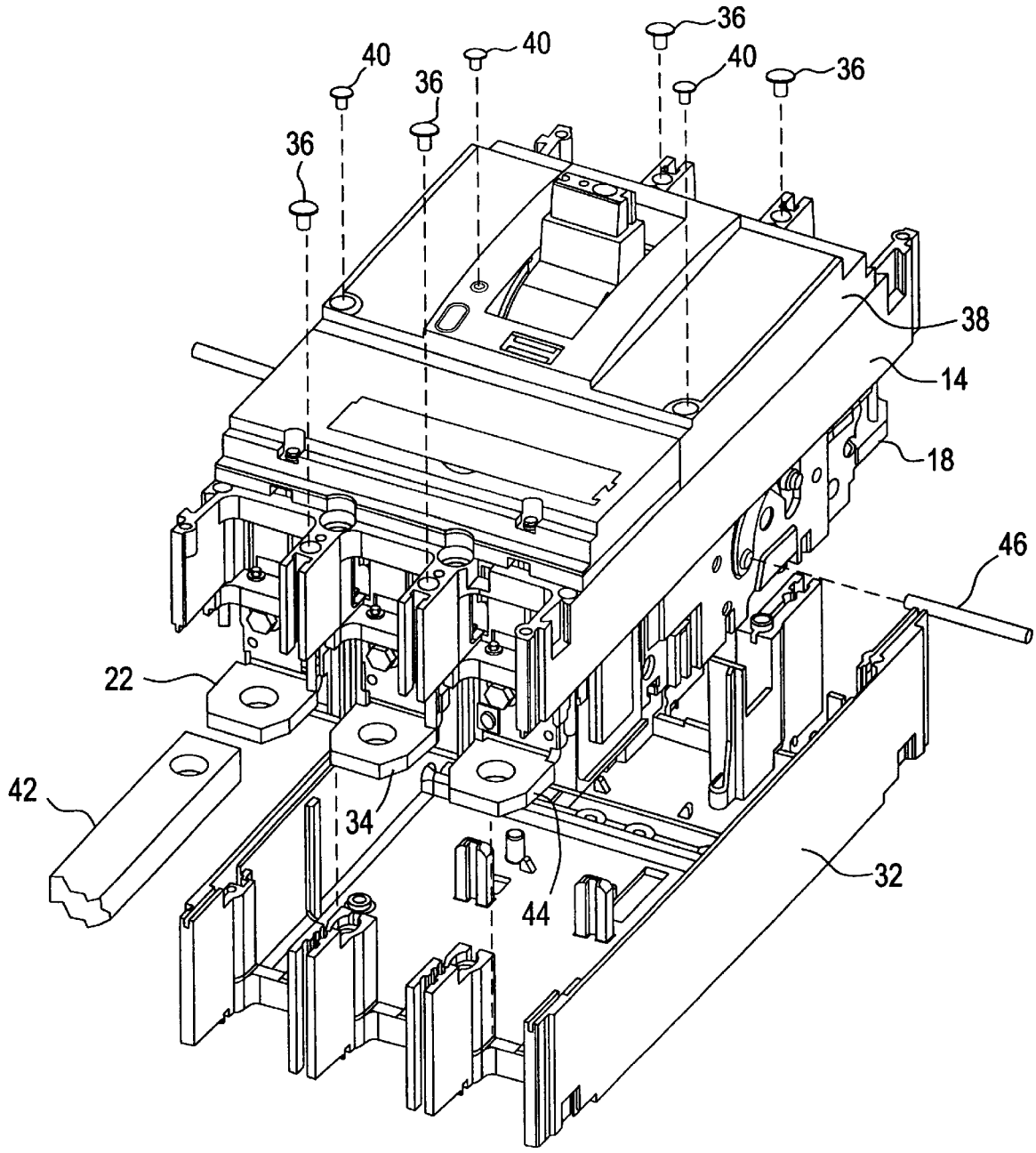
FIG. 2 is an exploded view of the circuit breaker of FIG. 1.
Figure 3:
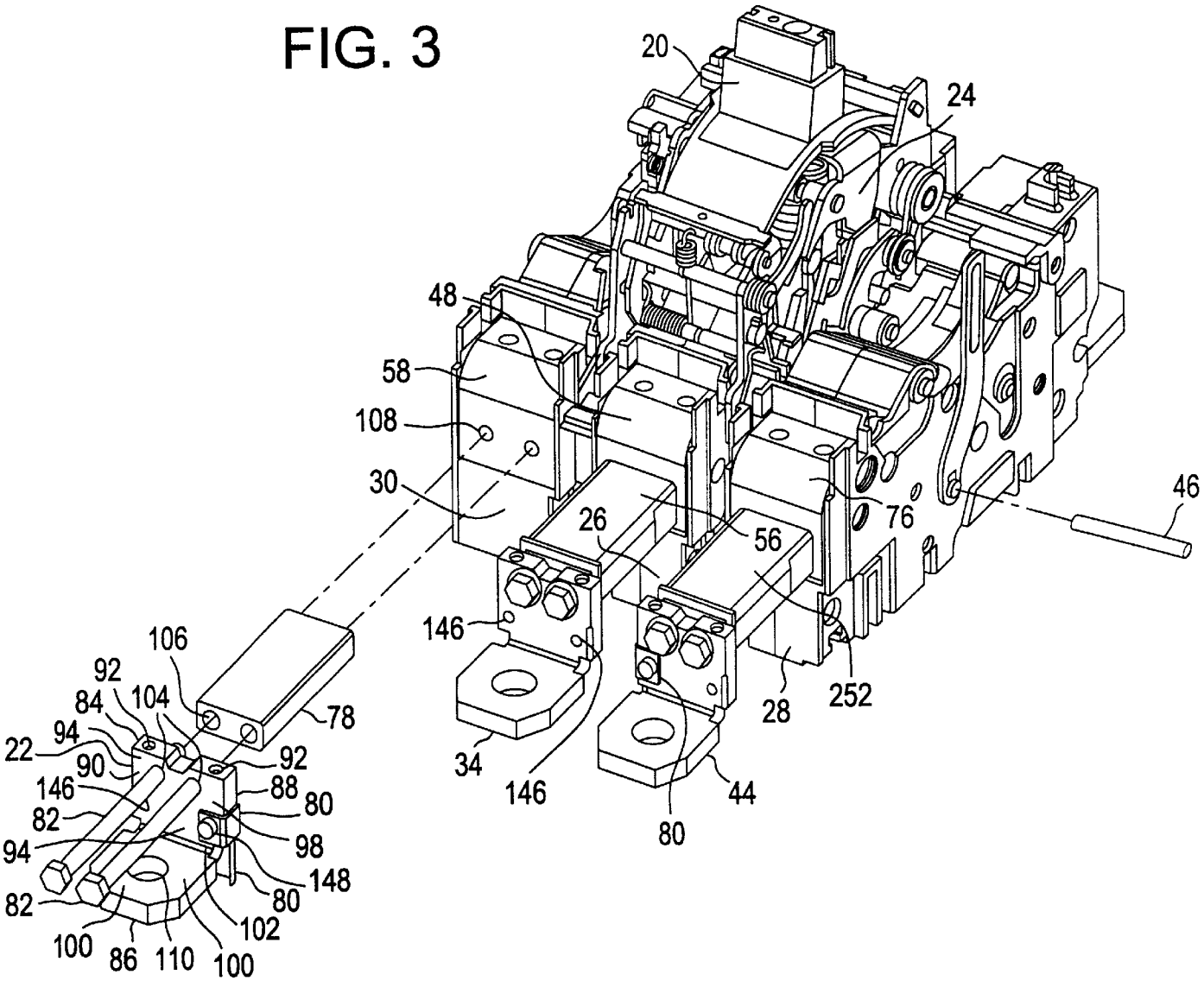
FIG. 3 is a perspective view of the assembly of a clip attached to a load strap.

Referring to FIGS. 2 and 3, the handle 20 is attached to a circuit breaker operating mechanism 24. The circuit breaker operating mechanism 24 is coupled with a center cassette 26 and is connected with outer cassettes 28 and 30 by a drive pin 46. The cassettes 26, 28, 30 along with the circuit breaker operating mechanism 24 are assembled into the base 32 and retained therein by the mid-cover 14. The mid-cover 14 is connected to the base 32 by any convenient means, such as screws 36, snap-fit (not shown) or adhesive bonding (not shown). Cover 38 is attached to the mid-cover 14 by screws 40.

The load straps 22, 34, 44 connect the circuit breaker to load side wiring such as a lead 42 from electrical equipment. Line straps 18 connect to line-side wiring (not shown) in an electrical distribution circuit.

Figure 4:
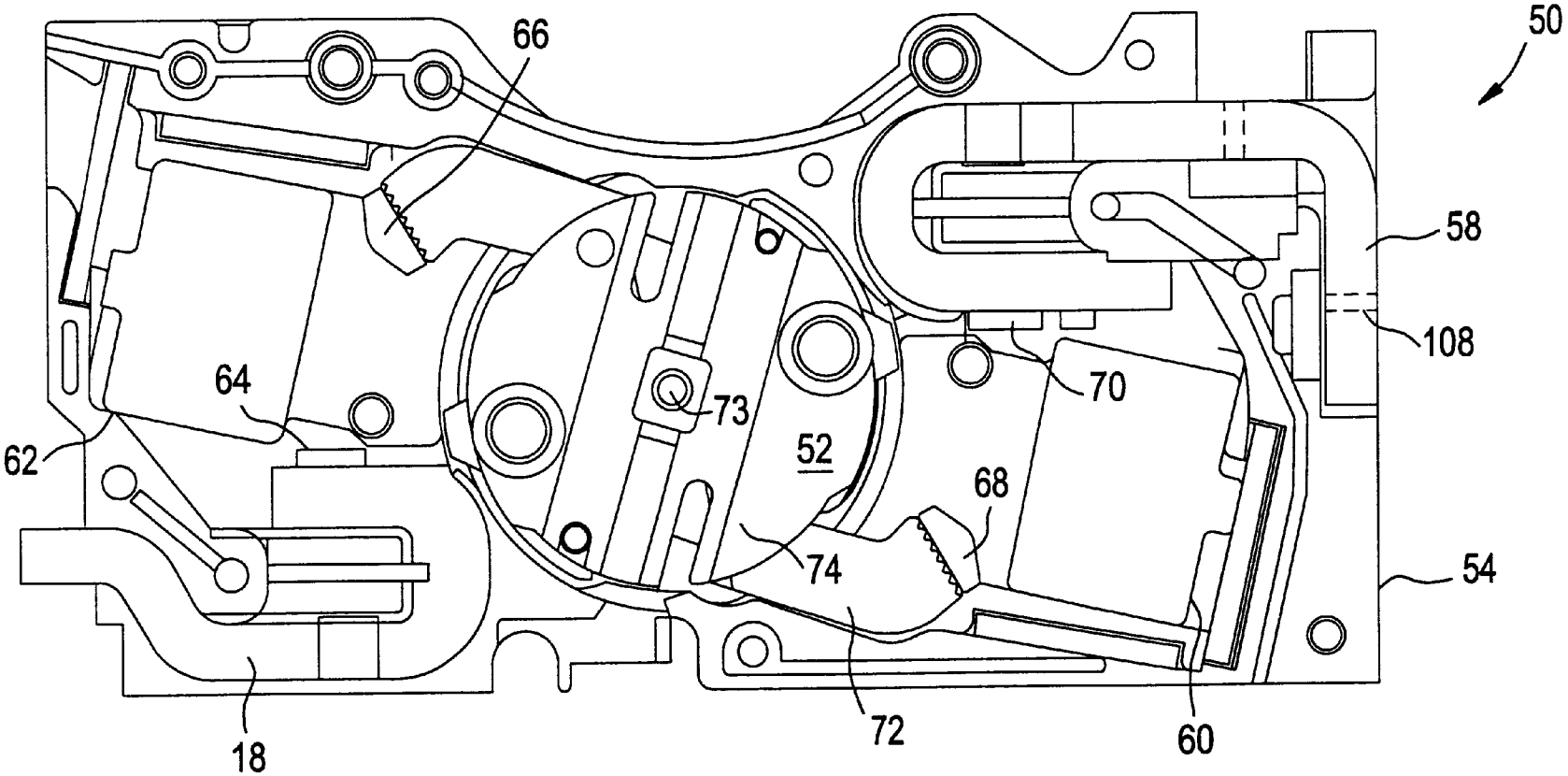
FIG. 4 is a perspective view of a circuit breaker cassette assembly.

Referring to FIG. 4, a circuit breaker cassette assembly, generally shown at 50, comprises a rotary contact assembly, shown generally at 52, in a first electrically-insulative cassette half-piece 54 of cassette 30 intermediate a line strap 18, and a load-side contact strap 58. Although only a single circuit breaker cassette assembly 50 is shown, a separate circuit breaker cassette assembly is employed for each pole of a multi-pole circuit breaker and operates in a manner similar to that of circuit breaker cassette assembly 50.

Electrical transport through rotary contact assembly 52 of circuit breaker cassette assembly 50 occurs from line strap 18 to an associated first fixed contact 64, through first and second movable contacts 66, 68 secured to the ends of a movable contact arm, shown generally at 72, and to an associated second fixed contact 70 on load-side contact strap 58. Movable contact arm 72 is pivotally arranged between two halves of a rotor 74 and moves in conjunction with rotor 74 upon manual articulation of rotor 74. Rotor 74 is rotatably positioned on a rotor pivot axle 73, the ends of which are supported by inner parallel walls of first electrically-insulative cassette half-piece 54.

Arc chute assemblies 60, 62 are positioned in the first electrically insulative cassette half piece 54 adjacent the respective pairs of first fixed and first moveable contacts 64, 66 and second fixed and second moveable contacts 70, 68. The first and second movable contacts 66, 68 and moveable contact arm 72 move through a passageway provided by the arc chute assemblies 60, 62 in order to engage and disengage from the respective first and second fixed contacts 64, 70. Each arc chute assembly 60, 62 is adapted to interrupt and extinguish the arc which forms when the circuit breaker 10 is tripped and the first and second moveable contacts 66, 68 are suddenly separated from the first and second fixed contacts 64, 70.

Referring back to FIG. 3, it is understood circuit breaker cassettes 26, 28 within circuit breaker 10 are similarly constructed to circuit breaker cassette assembly 50 including rotary contact assembly 52 described herein.

A perspective view of cassettes 26, 28, 30 is shown along with the operating mechanism 24 and load side connections. Further, a clip 80 is shown mounted to load strap 22. More specifically, load strap 22 is connected to a conductor 78 that is in turn connected to the load side contact strap 58. Load straps 34, 44 are similarly configured for attachment to conductors 82, 252, respectively. It is understood that the following description applies equally to all poles in circuit breaker 10.

A trip unit, such as a thermal magnetic trip unit (not shown) enclosed within case 12 preferably attaching to load side contact straps 48, 58, 76 of cassette 26, 28, 30 with mechanical fasteners or other methods commonly used in circuit breaker manufacture are contemplated, such as brazing. The trip unit is assembled into the base 32 along with the cassettes 26, 28, 30. Load straps 22, 34, 44 conduct current from the power source to the protected circuit. A current transformer (not shown) for an electronic trip unit (not shown) may be disposed around conductors 78, 56, 252, respectively.

Load strap 22 has a first end 84, a second end 86, an edge 88 and an opposing edge 90. First end 84 includes two apertures 92 spaced apart. Although two apertures 92 are preferred, load strap 22 may employ a single aperture 92 or more than two apertures 92. Load strap 22 includes a surface 94 facing the exterior of the circuit breaker 10 and a surface 96 facing the interior of the circuit breaker 10. Edge 88 and opposing edge 90 are located between the first end 84 and the second end 86. Load strap 22 further includes a first section 98 and a second section 100. First section 98 and second section 100 are integrally joined at an edge 102. First section 98 is located between the first end 84 and edge 102. Second section 100 is located between second end 86 and edge 102. Located within the first section 98 proximate the first end 84 is a circular aperture 104, preferably two circular apertures 104 aligned cross-wise and spaced apart, for accepting a mechanical fastener 82, preferably a screw or rivet. In this way, mechanical fasteners 82 are inserted through apertures 104, through corresponding apertures 106 located longitudinally through conductor 78 and finally through corresponding apertures 108 located in the load side contact strap 58.

The second section 100 of load strap 22 is angled inward toward surface 94. Preferably, the second section 100 is angled to be substantially perpendicular to the first section 98. Centrally located within the second section 100 is a circular aperture 110. In this way, the second section 100 is angled and extends outward from base 32 of circuit breaker 10 such that circular aperture 110 provides an accessible connection to the end user such as to connect to lead 42 from electrical equipment. It is understood that load straps 34, 44 are similarly configured to load strap 22.

Figure 5:
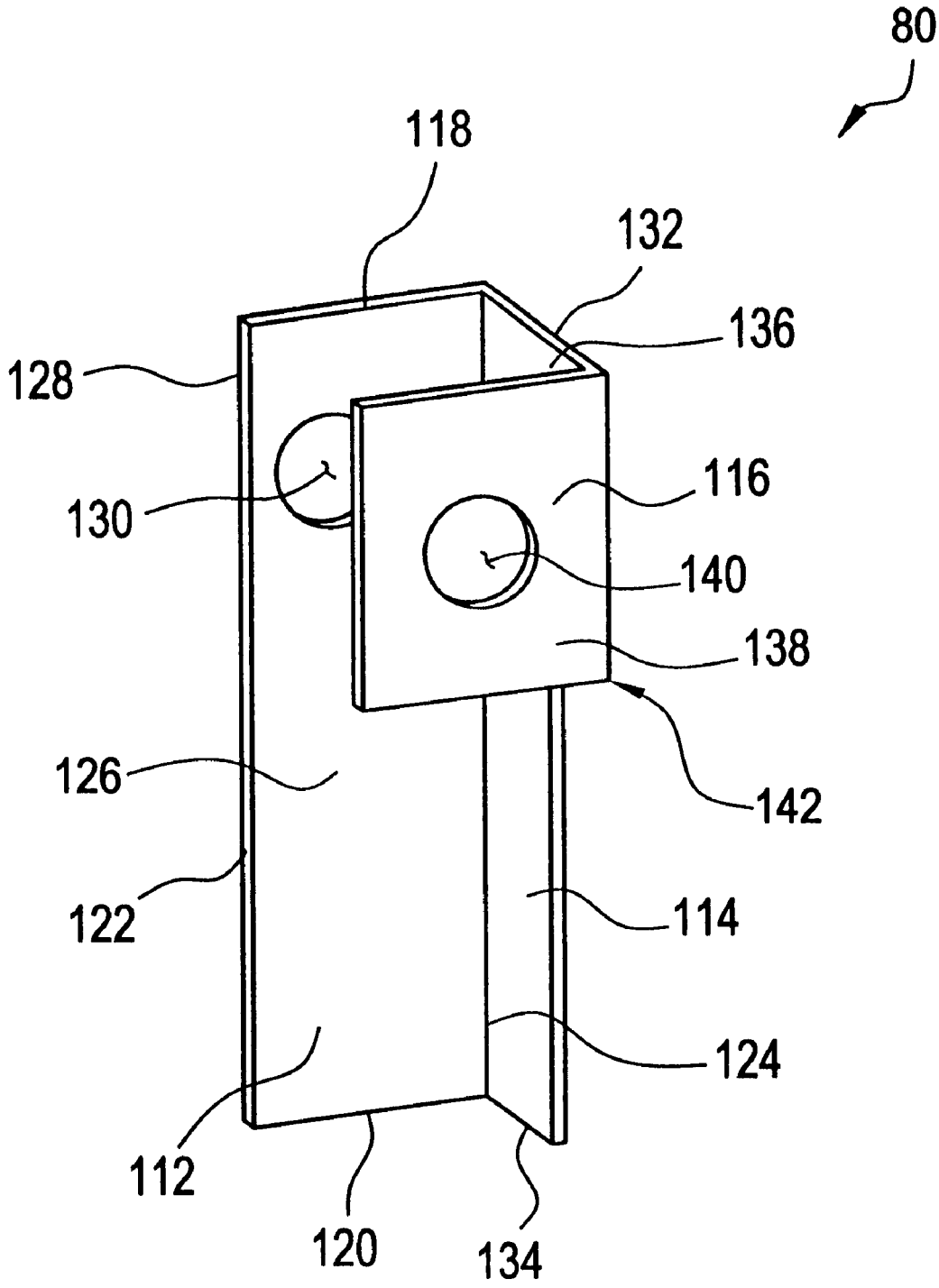
FIG. 5 is a perspective view of the clip of FIG. 3.

Referring to FIG. 5, clip 80 generally includes a main body portion 112, a flange 114 and an arm 116. Preferably, clip 80 is made of a metal, although any material of suitable strength may be used. The main body portion 112 includes a first end 118, a second end 120, a first edge 122 and a second edge 124. First and second edges 122, 124 extend longitudinally from the first end 118 to the second end 120. Also, main body portion 112 has a first surface 126 and an opposing second surface 128. First and second surfaces 126, 128 extend lengthwise between first and second ends 118, 120 and are bounded by the first and second edges 122, 124. The main body portion 112 is generally rectangular in shape extending lengthwise between first end 118 and second end 120. Proximate to the first end 118 and located within the main body portion 112 and extending through first and second surfaces 126, 128 is a circular aperture 130. Extending outward from the main body portion 112 is flange 114. Flange 114 is integral with the main body portion 112 and extends between the first end 118 and the second end 120 of the main body portion 112. Flange 114 has a first end 132 and a second 134 and is preferably bent towards first surface 126. Most preferably, the flange 114 is bent such that it is substantially perpendicular to the main body portion 112. Extending outward from the flange 114 proximate to the first end 132 is arm 116. Arm 116 extends outward along a portion of the flange 114. Preferably, the arm 116 is angled inwards towards first surface 126 of main body portion 112 forming a base section 136 extending from the flange 114 and a free section 138. Preferably, the arm 116 is continuous with the flange 114. The free section 138 includes a circular aperture 140. Preferably, the free section 138 is angled parallel to the main body portion 112 such that the circular aperture 140 of the free section 138 is aligned with the circular aperture 130 of the main body portion 112. Most preferably, the free section 138 is substantially perpendicular to the base section 136 such that the arm 116, the portion of the flange 114 adjacent to arm 116 and the portion of the main body portion 112 adjacent to arm 116 collectively form a U-shaped member shown generally at 142.

Referring back to FIG. 3 as well as FIG. 5, clip 80 is shown assembled onto the load strap 22 prior to assembly of the load strap 22 with the clip 80 attached onto base 32 (FIG. 1). The manner in which clip 80 is assembled onto the load strap 22 will now be described.

To fasten clip 80 onto the load strap 22, the arm 116, the portion of the flange 114 adjacent to arm 116 and the portion of the main body portion 112 adjacent to arm 116 is slidably inserted over edge 88 of the first section 98 of the load strap 22 such that circular apertures 130, 140, 146 are aligned. Next, a rivet 148 or other similar mechanical fastener is inserted, preferably through circular aperture 140, through circular aperture 146 and finally through circular aperture 130 to securely fasten clip 80 onto load strap 22. Although a mechanical fastener is used to effect the connection, any convenient method used in circuit breaker manufacture can be used.

Figure 6:
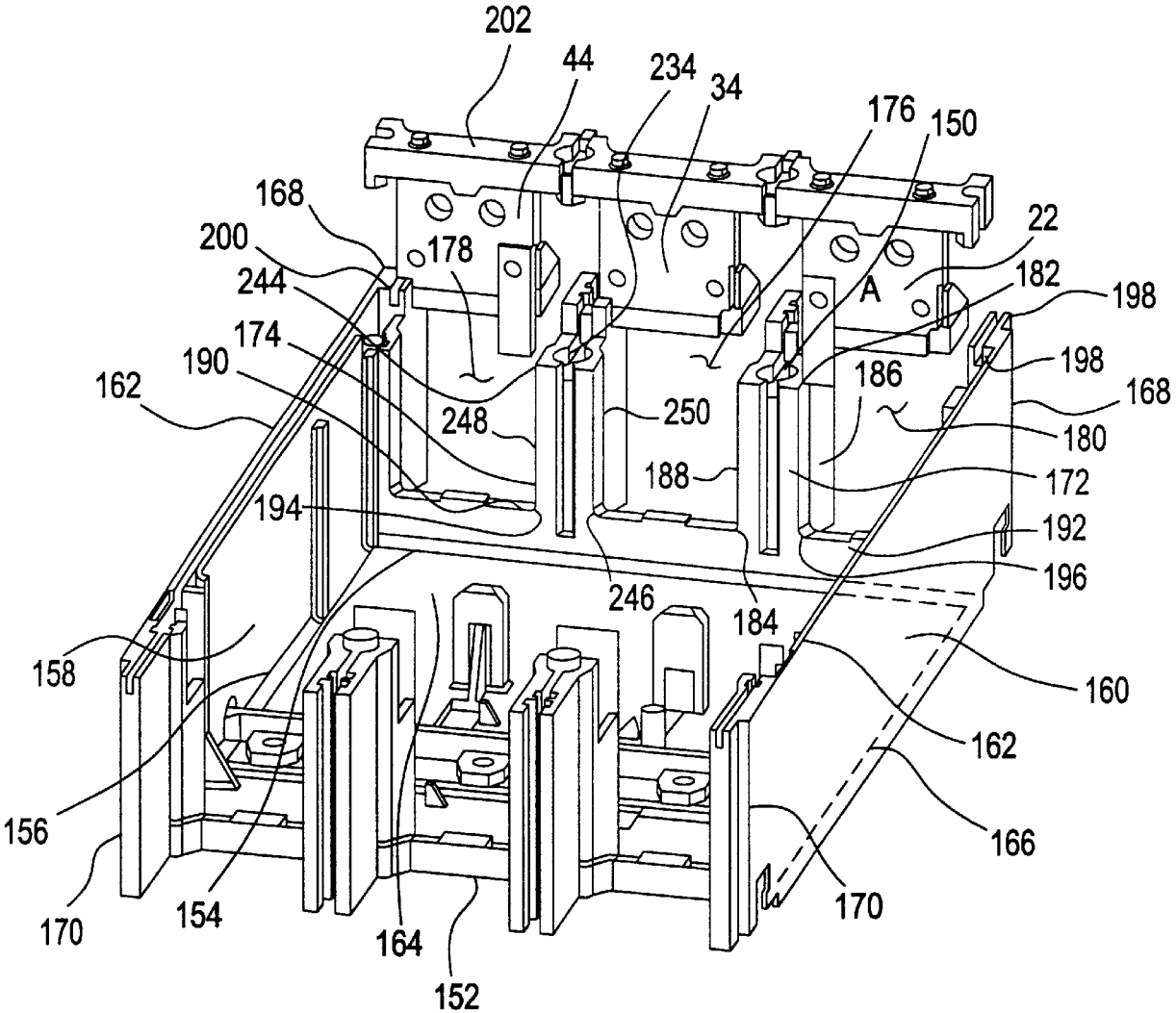
FIG. 6 is perspective view of the base of the circuit breaker of FIG. 1 including the assembly of the clip, the load strap and a cross bar.
Figure 8:
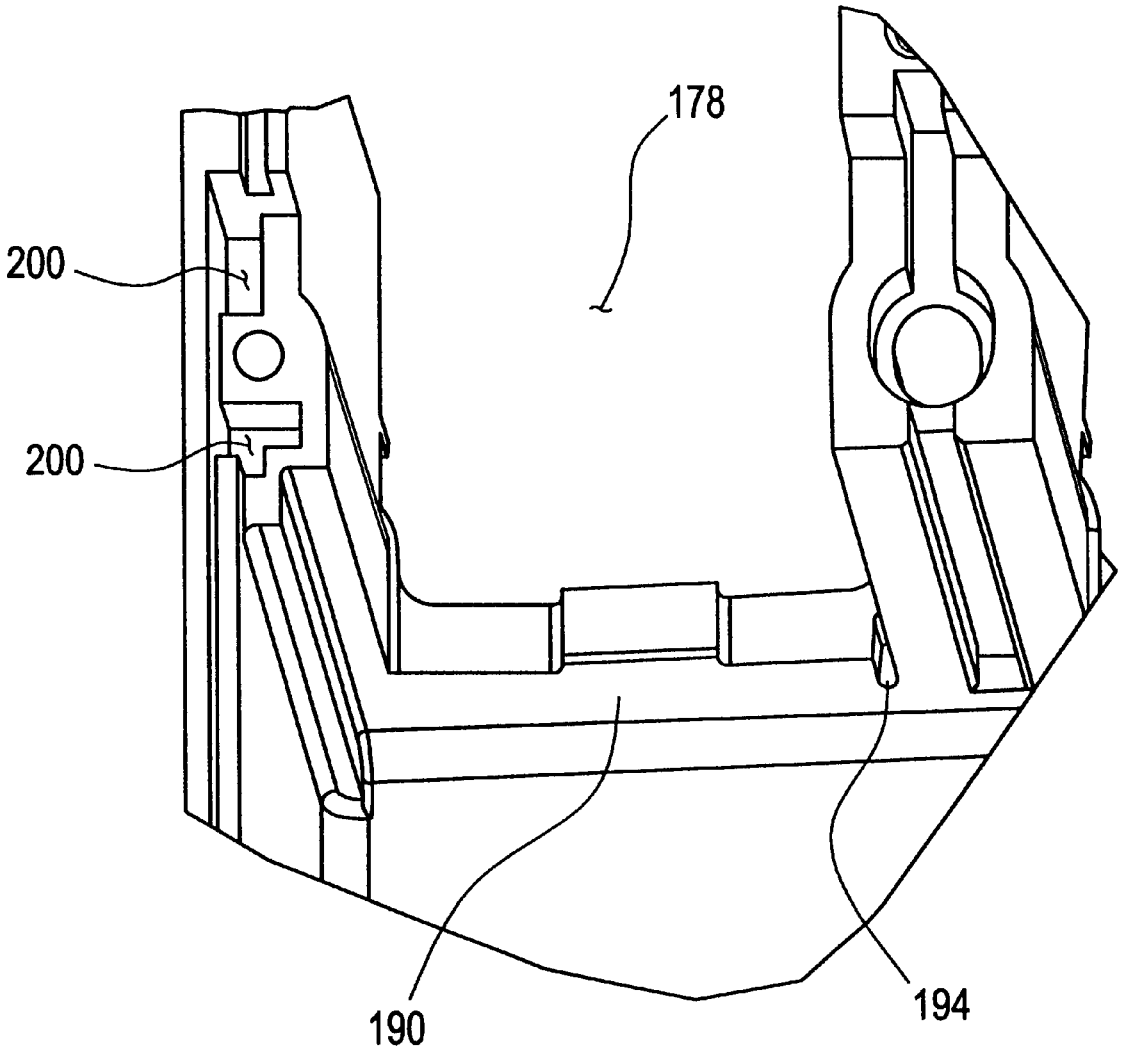
FIG. 8 is an exploded cut-away view of the base of the circuit breaker of FIG. 6.

Referring to FIG. 6, the assembly of load strap 22 with attached clip 80 to base 32 is shown. Referring also to FIG. 8, an exploded cut away view of the base 32 is shown.

Base 32 includes a floor section 164 having an end 152 located at the line side, and an end 154 located at the load side. Located between ends 152, 154 is an edge 156 and an opposing edge 166 (shown in phantom). Opposing sidewalls 158, 160 extend upward from floor section 164. Each sidewall 158, 160 has a top edge 162 and join with the floor section 164 at edges 156, 166, respectively. Each sidewall 158, 160 also includes a first end 168 at the load side and a second end 170 at the line side. Located proximate the first end 168 on the top edge 162 of sidewall 158 are two notches 198 spaced apart. Located proximate the first end 168 on the top edge 162 of sidewall 160 are two notches 200 spaced apart.

Partitions 172, 174 are located between sidewalls 158, 160 on the load side and extend upward from floor section 164, preferably perpendicular to floor section 164. Partition 172 and partition 174 define an opening 176 corresponding to a second pole of the circuit breaker 10. Partition 174 and sidewall 158 from an opening 178 corresponding to the first pole of the circuit breaker. Partition 172 and sidewall 160 form an opening 180 corresponding to the third pole of the circuit breaker 10. All openings are generally the same size.

Partition 172 has a first end 182 and a second end 184 where the second end 184 is integral with floor section 164. Partition 174 has a first end 244 and a second end 246 where the second end 246 is integral with floor section 164. Located at the first end 244 of partition 174 is an opening 234. Located at the first end 182 of partition 172 is an opening 150. Partitions 172, 174 are parallel to each other. FIG. 6 shows base 32 suitable for use in a three pole circuit breaker and thus has three openings 176, 178, 180. It is noted that the number of openings correspond to the number of poles in the circuit breaker 10 (FIG. 1).

Further, partition 172 has a first side 186 and a second side 188. First side 186 faces outward and second side 188 faces inward. Located within the floor section 164 of base 32 and proximate the first side 186 of partition 172 is a projection 190 extending upward from floor section 164. Partition 174 has a first side 248 and a second side 250. First side 248 faces outward and second side 250 faces inward. Located within the floor section 164 of base 32 and proximate the first side 248 of partition 172 is a projection 192 extending upward from floor section 164. Projections 190, 192 extend generally parallel to partitions 172, 174 respectively. Preferably, projections 190, 192 are integrally molded with the floor section 164 and protrude outward therefrom. Projection 190 and first side 186 of partition 172 form a slot 194 extending outward from the floor section 164. Similarly, projection 192 and first side 186 of partition 172 form a slot 196 extending outward from the floor section 164.

Located on the top edge 162 of sidewall 158 proximate to the load side end and integrally molded therein is a notch 198, preferably two notches. Located on the top edge 162 of sidewall 160 proximate to the load side end and integrally molded therein is a notch 200, preferably two notches.

A cross bar 202 is also shown. The cross bar 202 provides additional structural support for the sidewalls 158, 160 as well as providing support and attachment for the load straps 22, 34, 44. Cross bar 202 is preferably molded of a plastic material such as a bulk molding compound with a sufficient dielectric strength to provide sufficient electrical insulation between the phases (poles).

Figure 7:
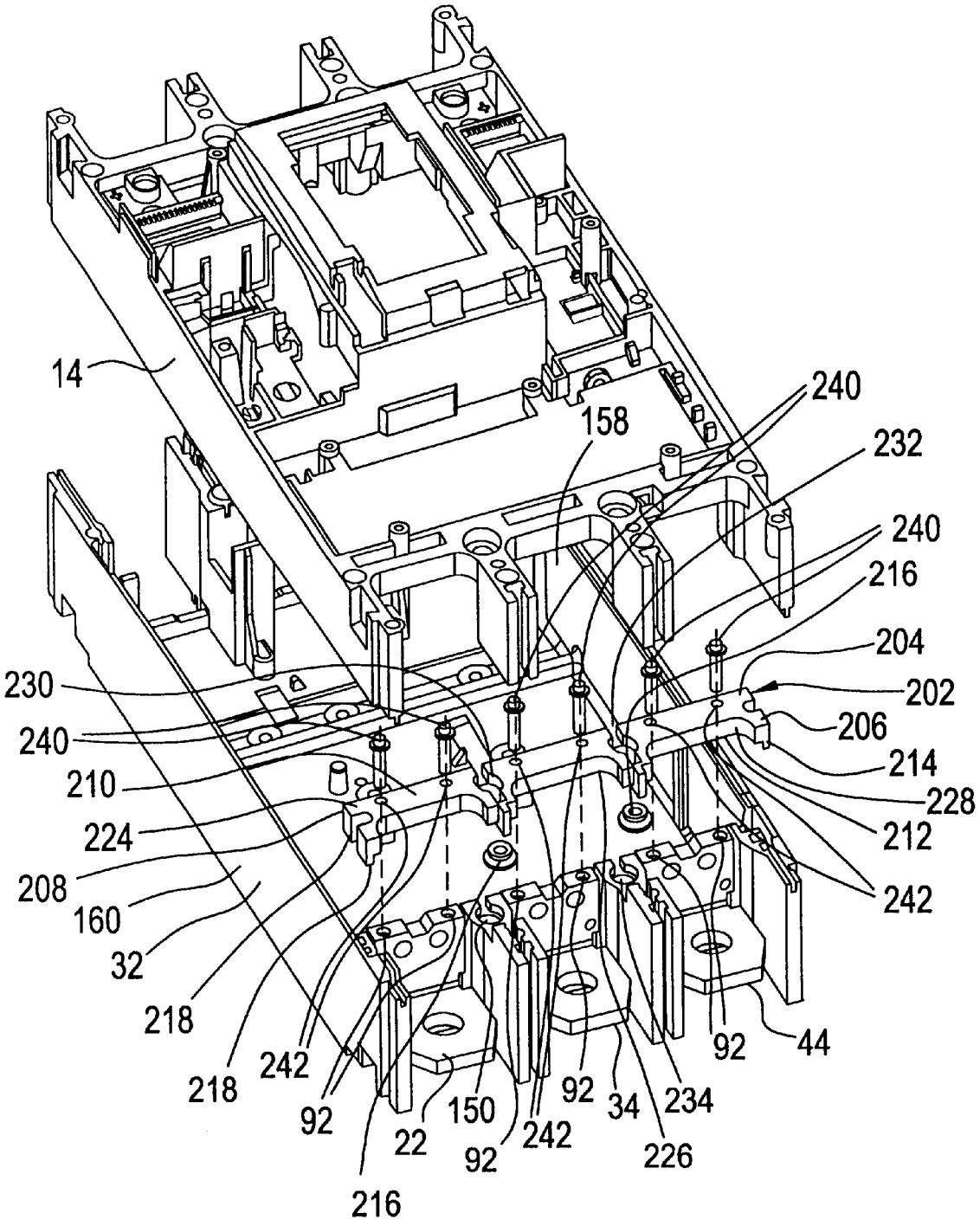
FIG. 7 is a perspective view of the base, the mid cover and the assembly of a cross bar.

Referring to FIGS. 7 and 8, the cross bar 202, the base 32 and the midcover 14 assembly is shown. The cross bar 202 will be described in further detail. Further, although a cross bar 202 is shown being utilized in a three pole circuit breaker, it is understood that the cross bar 202 may be employed in a single pole circuit breaker as well as a multi pole circuit breaker.

Cross bar 202 includes a body 204 having first end 206, a second end 208, a top surface 210 and a bottom surface 212. Extending inward towards the interior of the circuit breaker 10 from the bottom surface 212 and located proximate the first end 206 is a projection 214, preferably two projections 214 spaced apart from one another at first end 206. Extending inward towards the interior of the circuit breaker 10 from the bottom surface 212 and located proximate the second end 208 is a projection 218, preferably two projections 218 spaced apart from one another at second end 208. Cross bar 202 also includes a first section 224, a second section 226 and a third section 228. First, second and third sections 224, 226, 228 are integral sections each including an aperture, preferably two, 242 for connection to respective load straps 22, 34, 44 for each of the respective poles. It is noted that the number of apertures provided for in the cross bar 202 may be less than or greater than two. Located within the body 204 of the cross bar 202 is an opening 230 located between the load strap 22 and the load strap 34. An opening 232 is also located between the load strap 34 and the load strap 44. Openings 230, 232 extend from the top surface 210 to the bottom surface 212 and are adapted to accept a mechanical fastener (not shown) to secure the circuit breaker (FIG. 1) to a mounting member (not shown) such as, but not limited to, a panel and align with corresponding openings 150, 234 located within the respective partitions 172, 174 thereby connecting the cross bar 202 to the base 32 using a mechanical fastener 216, preferably a screw. The openings 230, 232 mechanically lock all three straps 22, 34, 44 together by securing the first, second and third sections 224, 226, 228. The openings 230, 232 also aid in over surface and through air spacing. Air spacing is desirable to reduce the risk of a short circuit.

Referring to FIGS. 6 and 7, the load strap 22 with the clip 80 attached is shown assembled within base 32. The assembly will be described in reference to load strap 22. However, it is understood that clip 80 may also be utilized to mount load straps 34, 44, corresponding to the respective second and third poles of the circuit breaker 10, within base 32.

The load strap 22 is slidably received within opening 180 such that the second end 134 of the flange 114 of the clip 80 is slidably inserted into slot 196 such that flange 114 is accepted within slot 196. When the load straps 22, 34, 44 are fully inserted into the respective openings 176, 178, 180, the projections 214 located on the cross bar 202 are captively received within notches 198 located on the top edge 162 of sidewall 158 and the projections 218 located on the cross bar 202 are captively received within notches 200 located on the top edge 162 of sidewall 160.

When assembled, second surface 96 of load strap 22 faces inward towards base 32 and first surface 94 faces outward. In this way, clip 80 rivets towards the inside of the circuit breaker 10 (FIG. 1) providing for maximum support of load strap 22.

When the clip 80 engages slot 196, load strap 22 is provided additional structural support to assist in the prevention of translational and rotational movement of load strap 22 during assembly and interruption (e.g. short circuit) events. During an interruption event, load strap 22 tends to rotate about a centrally located point A (FIG. 6) towards the exterior of circuit breaker (FIG. 1). That is to say, load strap 22 rotates counterclockwise when viewed from the exterior of circuit breaker 10. During assembly, force is also applied to load strap 22 to effect the connections to the load side wiring such as the load sided contact strap 58 and lead 42 from electrical equipment as described hereinabove. The clip 80 is placed over the edge 88 to stabilize the load strap 22 during rotational and translational movement exerted on the load strap 22 during interruption as well as translational and rotational forces acting on the load strap 22 during end user connection of various electrical equipment to load strap 22. In this way, clip 80 is forced against the partition 172 thereby providing additional support for load strap 22 to assist in the prevention of its translational and rotational movement.

Once the load strap 22 is assembled into the base 32 as described hereinabove, the cross bar 202 is attached to the load straps 22, 34, 44 and connected to the sidewalls 158, 160 as follows.

The first section 224 of the cross bar 202 is securely located onto the first end 84 of the load strap 22 by inserting mechanical fasteners 240 through apertures 242 located within the first section 224 of the cross bar 202 and through apertures 92 located in the first end 84 of the load strap 22. The second section 226 of the cross bar 202 is securely located onto the first end 84 of the load strap 34 by inserting mechanical fastener 240 through apertures 242 located within the second section 226 of the cross bar 202 and through apertures 92 located in the first end 84 of the load strap 34. The third section 228 of the cross bar 202 is securely located onto the first end 84 of the load strap 44 by inserting mechanical fastener 240 through apertures 242 located within the third section 228 of the cross bar 202 and through apertures 92 located in the first end 84 of the load strap 44.

As described herein, the cross bar 202 securely locks the load straps 22, 34, 44 within base 32. Cross bar 202 is advantageously employed in base 32 that is employed in a modular circuit breaker design where size must be optimized. Further, cross bar 202 is also advantageously used within circuit breakers where overall space requirements can be kept to a minimum thus not requiring the internal structure of base to be made larger for increase load strap support.

As described herein, the clip 80 provides support for load strap 22 thus limiting load strap 22 movement during assembly and interruption events thus decreasing the stresses exerted on the base 32 from the load strap 22 during these events. Clip 80 is advantageously employed in base 32 employed in a modular circuit breaker design where size must be optimized. Further, clip 80 is also advantageously used within circuit breakers where overall space requirements can bee kept to a minimum thus not requiring the internal structure of base to be made larger for increase load strap support.

Further, by using clip 80, the load strap 22 is able to extend from base 32, as opposed to being secured within the base 32. This configuration for the load strap 22 is preferred over being secured within the base 32 since the end user is now provided top and bottom access to circular aperture 110. The clip 80 also provides additional support to ensure the integrity of base 32 during assembly of the electrical connections to the circuit breaker as well as during interruption events.

It is understood that although FIG. 8 is an exploded view, in part, of the projection 190 and slot 194, the projection 192 and slot 196 are similarly configured and disposed within the floor section 164 of base 32 as identified in FIG. 6.

Finally, it is understood that multiple clips 80 may be utilized as shown in FIG. 3. In a preferred embodiment, and as shown in FIG. 3, clips 80 are mounted to load straps 22 and 44. In this way, movement of the load straps 22, 44, which correspond to the outermost poles of the multi-pole circuit breaker 10 (FIG. 1), is minimized during an interruption event and assembly, thereby ensuring increased structural integrity to the sidewalls 158, 160.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker assembly comprising:

a base including:

a floor section;

a first side wall having a top edge, said first side wall joined to said floor section, a second wall having a top edge, said second side wall joined to said floor section, said first and second sidewalls extending upward from said floor section, a first partition extending upward from said floor section and between said first and second side walls, said floor section having a projection extending upward from said floor section adjacent to said first partition, said projection and said first partition defining a slot, wherein said first partition, said floor section and said first sidewall opposing said first partition define a first opening;

a conductive strap received within said first opening; and a clip including:

a main body portion having a first surface, a first edge and a second edge, said first surface disposed between said first edge and said second edge;

a flange extending from said first edge of said main body portion;

an arm extending along a portion of said flange, said arm is angled towards said first surface of said main body portion;

wherein said first surface, said flange, and said arm define a U-shaped member for receiving said conductive strap; and wherein said flange engages said slot during assembly of said conductive strap within said first opening.

2. The circuit breaker of claim 1, wherein said arm includes an aperture; and wherein a fastener is disposed through said aperture to secure said arm to said conductive strap.

3. The circuit breaker of claim 1, wherein said main body portion includes an aperture; and wherein a fastener is disposed through said aperture to secure said main body portion to said conductive strap.

4. The circuit breaker of claim 1, wherein said clip is made from metal.

5. The circuit breaker of claim 1, wherein said projection is integrally formed with said floor section.

6. A circuit breaker assembly comprising:

a base including:

a floor section;

a first side wall having a top edge, said first side wall joined to said floor section, a second wall having a top edge, said second side wall joined to said floor section, said first and second sidewalls extending upward from said floor section, a first partition extending upward from said floor section and between said first and second side walls, said floor section having a projection extending upward from said floor section adjacent to said first partition, said projection and said first partition defining a slot, wherein said first partition, said floor section and said first sidewall opposing said first partition define a first opening;

a conductive strap received within said first opening;

a cross bar, said cross bar is fastened to said conductive strap; and a clip including:

a main body portion having a first surface, a first edge and a second edge, said first surface disposed between said first edge and said second edge;

a flange extending from said first edge of said main body portion;

an arm extending along a portion of said flange, said arm is angled towards said first surface of said main body portion;

wherein said first surface, said flange, and said arm define a U-shaped member for receiving said conductive strap; and wherein said flange engages said slot during assembly of said conductive strap within said first opening.

7. The circuit breaker of claim 6, wherein said arm includes an aperture; and wherein a fastener is disposed through said aperture to secure said arm to said conductive strap.

8. The circuit breaker of claim 6, wherein said main body portion includes an aperture; and wherein a fastener is disposed through said aperture to secure said main body portion to said conductive strap.

9. The circuit breaker of claim 6, wherein said clip is made from metal.

10. The circuit breaker of claim 6, wherein said projection is integrally formed with said floor section.

* * * * *